US006134821A

United States Patent [19]

Love

[11] Patent Number: 6,134,821

[45] Date of Patent: Oct. 24, 2000

[54] MAGNETIC SIGNAGE SYSTEMS AND PROCESSES RELATED THERETO

[75] Inventor: Thomas G. Love, Marietta, Ohio

[73] Assignee: Magnum Magnetics, Marietta, Ohio

[21] Appl. No.: 09/008,055

[22] Filed: Jan. 16, 1998

[51] Int. Cl.[7] ..... G90F 7/04

[52] U.S. Cl. ..... 40/600

[58] Field of Search ..... 40/600, 621, 660, 40/661.01, 711; 229/93

[56] References Cited

U.S. PATENT DOCUMENTS

| | | | |
|---|---|---|---|
| 1,032,282 | 7/1912 | Hay | 40/660 X |
| 1,264,795 | 4/1918 | Hill . | |
| 2,501,615 | 3/1950 | Pugh . | |
| 2,547,359 | 4/1951 | Bacharach | 40/124.11 X |
| 2,756,924 | 7/1956 | Abrahamson | 229/93 |
| 2,805,816 | 9/1957 | Morgan . | |
| 3,077,981 | 2/1963 | Gaspard | 40/660 X |
| 3,127,544 | 3/1964 | Blume, Jr. . | |
| 3,206,655 | 9/1965 | Reijnst . | |
| 3,808,404 | 4/1974 | Riggs . | |
| 4,287,676 | 9/1981 | Weinhaus . | |
| 4,292,262 | 9/1981 | Tobin, Jr. . | |
| 4,310,978 | 1/1982 | Stern . | |
| 4,339,885 | 7/1982 | Brown | 40/660 X |
| 4,339,886 | 7/1982 | Griffiths et al. | 40/595 |
| 4,379,276 | 4/1983 | Bouchara et al. . | |
| 4,544,590 | 10/1985 | Egan . | |
| 4,568,403 | 2/1986 | Egan . | |
| 4,663,874 | 5/1987 | Sano et al. | 40/600 X |
| 4,762,271 | 8/1988 | Lewyt . | |
| 4,887,763 | 12/1989 | Sano . | |
| 4,957,311 | 9/1990 | Geisenheimer . | |
| 4,966,285 | 10/1990 | Otake et al. . | |
| 4,969,013 | 11/1990 | Tsilibes . | |
| 5,036,310 | 7/1991 | Russell . | |
| 5,077,921 | 1/1992 | Mooney . | |
| 5,085,470 | 2/1992 | Peach et al. . | |
| 5,458,282 | 10/1995 | Martin . | |
| 5,503,891 | 4/1996 | Marshall et al. | 40/600 X |
| 5,809,679 | 9/1998 | Arjmand | 40/660 X |

*Primary Examiner*—Anthony Knight
*Assistant Examiner*—Enoch E Peavey
*Attorney, Agent, or Firm*—Vorys, Sater, Seymour and Pease

[57] ABSTRACT

A tubular signage assembly and related methods and components are provided which have a number of advantages and solve a number of problems over conventional magnetic signage products and processes. The assembly has an annular tube and at least one signage blank rolled up therein. The annular tube has instruction indicia thereon. The blank has a filled base layer having a magnetic powder filler and a thermoplastic resin, and has a surface layer having a thermoplastic material and a colorant. The blank preferably has indicia thereon for indicating the orientation of the magnetic pole of the blank. A method is also provided for making a magnetic sign from a large sheet of laminate involving cutting the laminate into blanks, placing a blank into a tubular body to form a tubular assembly, transporting the tubular assembly to a sign maker, placing indicia on the blank to form a sign and placing the sign in the tube for delivery to the user of the sign.

6 Claims, 3 Drawing Sheets

MAGNETIC SIGNAGE SYSTEMS AND PROCESSES RELATED THERETO

BACKGROUND OF THE INVENTION

1. Field of the Invention

The present invention relates to magnetic signage and related processes, and more particularly relates to magnetic signage for vehicles and processes related thereto.

2. Description of Related Art

Magnetic signage for vehicles is well known. Such signage has typically been made by a process involving the steps of (1) producing an admixture of magnetic powder and a thermoplastic material, (2) producing a flexible sheet of the admixture, magnetizing the flexible sheet, (4) laminating a thermoplastic resin surface layer onto the flexible sheet to form a laminate, (5) rolling the laminate into a the form of a large roll for storage and transport to a signage shop, (6) cutting the laminate into relatively small rectangular signage blanks, and (7) producing indicia on the blanks surface by printing or engraving. In practice, the above process has a number of problems and deficiencies.

The above conventional processes, and related products, typically have one or more of the following problems or deficiencies, namely: (a) the eventual signage maker needs to order a large roll of a given color of signage blank material when the maker's actual short term needs may be substantially less than an entire roll, (b) after the roll has been purchased by the signage maker, the maker must usually find a sufficiently cleared off large work area to cut the signage blank from the roll, (c) lifting of the roll to the work area can be difficult for a single worker to handle, thereby making such rolls impractical for small signage shops, (d) the number of blanks to be cut from a given sheet can vary greatly depending upon the sizes and shapes of the blanks eventually cut from the roll and consequently the number of care and cleaning instruction sheets needed for each roll is unknown, and (e) the use of a plurality of separate care and cleaning instruction sheets for each roll runs the risk that some purchasers of the signage may not receive the instructions. Also, for conventional magnetic signage systems, the sign shop and the end user have typically not had an adequate means of storing the signs and signage blanks.

Consequently, there is a need and a desire to overcome the above problems and deficiencies.

SUMMARY OF THE INVENTION

The present invention provides processes and products which overcome the above problems and deficiencies. The present invention involves a signage system assembly comprising: (a) at least one signage blank comprising (i) a base layer having magnetic powder (such as ferrite) and thermoplastic material and (ii) a surface layer comprising thermoplastic resin and colorant, and (b) a signage tube, preferably having a clear body section, and preferably having instruction indicia on the tube. Alternatively, a signage instruction sheet having instruction indicia thereon may placed in (positioned in) the tube. For premagnatized signage blanks, the signage blank preferably has orientation indicia (windedge indicia) thereon to indicate that the when the sign is stored in rolled form, the surface layer should be the radially outerwardmost side of the roll to optimize the wind resistance of the sign when the sign is in use. The sign tube may be used for storage of the final signage product in order to avoid undesired misshaping of the signage and to avoid loss of the instructions.

DETAILED DESCRIPTION OF THE INVENTION

Figure 1:
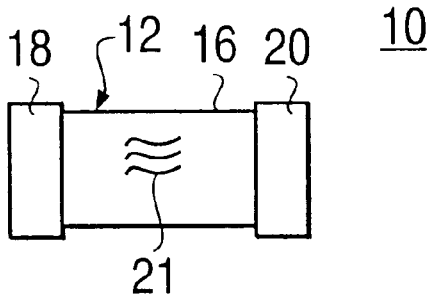
FIG. 1 is a side elevational view of the signage tube of the present invention.

As best shown in FIG. 1, a signage tube assembly (10) is provided comprising a signage tube (12) and a signage blank (14). The tube (12) has a transparent cylindrical (annular) body (16) and preferably a pair of end caps (18, 20). The body (16) is preferably made of a transparent thermoplastic resin for permitting the signage maker to rapidly determine the color of the blank (14) carried in the tube (12). The end caps (18, 20) fit over respective ends of the body (16) and permit easy access to the interior of the annular body (16). Preferably the end caps (18, 20) are colored to match the color of the blank (14) to further facilitate determination of the blank's color in the event that only an end of the tube (12) is visible during storage of the tube (12). The end caps (18, 20) are preferably cup shaped for receiving a respective end of the tube body (16). The blank (16) may be loosely rolled and slid (positioned) into the interior of the body (16) for being carried therein. The body (16) preferably has instruction indicia (21) thereon (or optionally an instruction sheet therein) for providing care (storage, use) and cleaning instructions for the signage blank (14) and any eventual signage, thereby ensuring that each purchaser of the assembly (10) is provided with appropriate care and cleaning instructions. In other words, the instruction indicia (21) functions with the structures of the assembly and with the underlying tube substrate (body) by providing clear instructions on the body (16) for care and cleaning of the blank (14). The presence of the indicia on the body (16) is advantageous over separate sheet instructions, in that the position of the instruction indicia (21) and its relationship to the body (16) insures that the indicia will be provided with the blank (14) without needing to be on the blank (14) and will not become lost during storage of the sign.

One of the advantages of the assembly (10) is that it is much lighter weight than a conventional signage roll (not shown) of magnetic powder filled thermoplastic, and thus is much more convenient and easy to use (and store) for signage shop owners (or any other user), and for signage shop owners having disabilities that make lifting of heavy rolls impractical, and the signage assembly (10) permits easy and convenient signage making.

Figure 2:
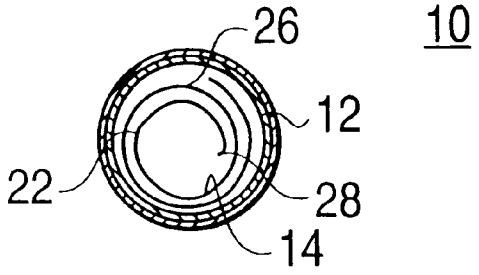
FIG. 2 is a front end view of the signage tube with a front cap removed.

As best shown in FIG. 2, the blank (14) may be rolled due to its flexible nature and slid (positioned) into the tube body (16) for retention therein. The assembly (10) shown in FIG. 2 has one cap (18) on the body (16) and has the other cap (20) removed for easy access to the blank (14) of the assembly (10). The transparent body (16) permits easy viewing of the blank (14) for quick determination of the color of the blank (14).

Figure 3:
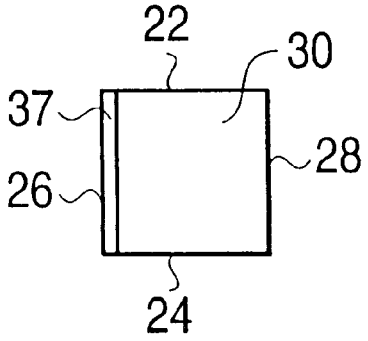
FIG. 3 is a top plan view of a magnetized signage blank with indicia.
Figure 4:
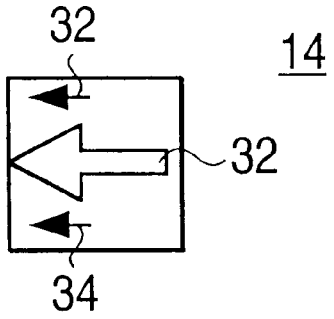
FIG. 4 is a bottom plan view of a signage blank of the present invention having indicia of orientation.
Figure 5:
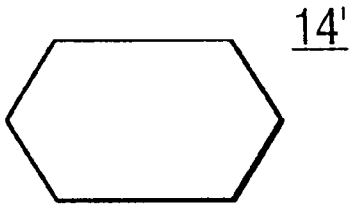
FIG. 5 is top plan view of a blank configured to indicate proper roll orientation for the signage blank.

As best shown in FIG. 3, the blank (14) is preferably rectangular (for example square) in shape having a first pair of spaced apart edges (22, 24) and a second pair of spaced apart edges (26, 28). As shown in FIG. 3, the edges are oriented such that there is a top edge (22), bottom edge (24), left side edge (26) and right side edge (28). The blank (14) has a front surface (30). As shown by arrows (32) the blank (14) of FIG. 4, the blank (14) should be rolled in a direction parallel to the side edges (26, 28) with the leading edge (26) being an outer edge of the roll and the trailing edge (28) being an inner edge of the roll. Preferably the blank (14) has means (32) for indicating the direction in which the blank should be rolled so that the signage maker can properly orient signage indicia (50) on the blank (14) so that the signage will lay with a flat leading edge to permit wind to cleanly flow over the signage during use on a metal (steel) side panel (35) of a vehicle (36). Preferably, the indicating means (32) is printed indicia (such as printed arrow patterns) on the back of the sign blank or optionally may be in the form of a colored edge (37) for example either left side edge (26) or right side edge (28) or any other small marking on (or as shown in FIG. 5, configuration of the blank (14')) the blank (14) to indicate the orientation of the leading edge and the direction for the blank/sign to be rolled during storage in the tube and the desired orientation during printing and the desired orientation of the sign on the vehicle (or the preferred wind direction).

Figure 6:
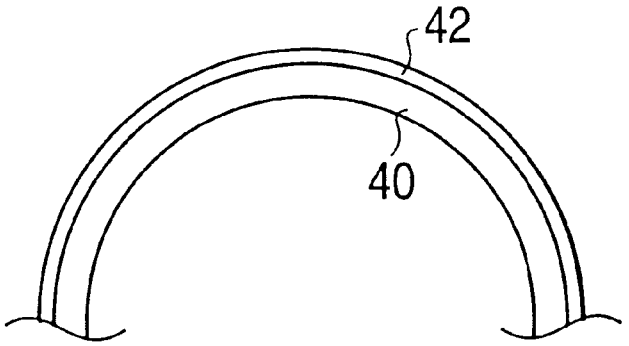
FIG. 6 is cutaway view of a rolled signage blank according to FIG. 1.
Figure 7:
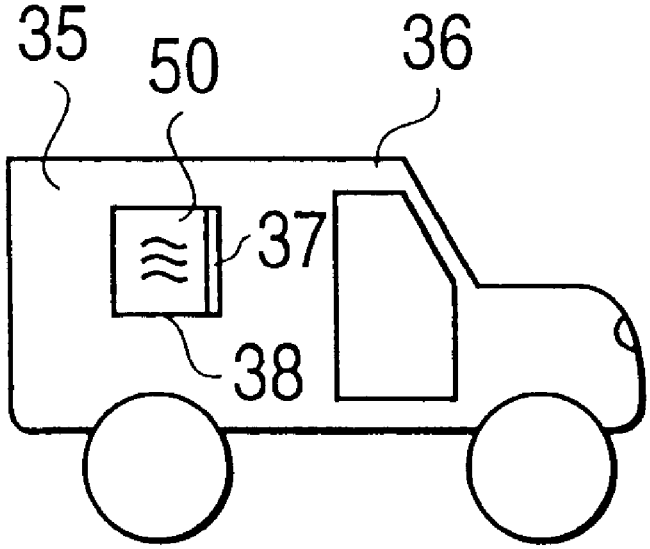
FIG. 7 is a side elevational view of a vehicle having a sign according to the present invention.
Figure 8:
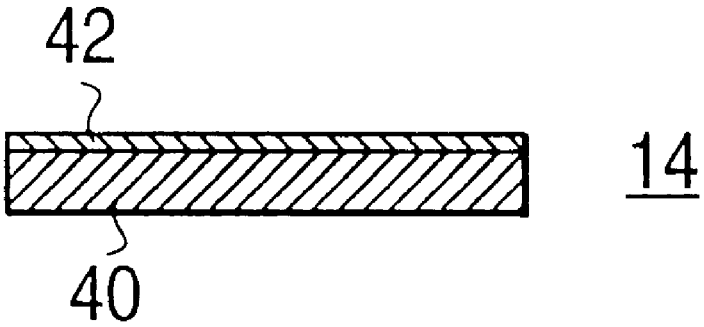
FIG. 8 is a cross-sectional view of the blank.

As best shown in FIG. 8, the blank (14) comprises an magnetic powder filled thermoplastic base layer (40) and a surface layer (42) comprising thermoplastic resin and colorant. The blank (14) preferably has a length of between 1.0 foot and 6 feet, more preferably between 18 inches and 48 inches, and most preferably between 18 inches and 36 inches, and preferably has a width (height) of between 6 inches and 36 inches, more preferably between 12 inches and 24 inches, and most preferably between 12 inches and 18 inches. The length of the tube body is at least the as great as the smallest width or length of the corresponding blank so that the blank may be rolled and contained within the tube body. The present invention also involves the rolling of the sign (signage blank) within the tube to minimize loss of the signs during use on a vehicle. As shown in FIG. 6, it is critical that the sign and signage blank have the surface layer (42) positioned outwardly relative to the base layer (40), and having the top (22) of the sign (signage blank) position adjacent an end of the tube (and consequently the bottom of the sign (signage blank) is positioned adjacent the bottom of the tube. Failure to roll the sign (signage blank) with the surface layer positioned (radially) outwardly relative to the base layer will result in the wind edge being raised above the surface of the side of the vehicle and will be easily caught by the wind during vehicular travel. Failure to roll the sign (signage blank) with the top adjacent an end of the tube will result in the in the wind edge (side edge) being curved allowing the wind to catch the wind edge. The present invention reduces the likelihood of unintentional (and undesirable) signage loss during use on a vehicle. As shown in FIG. 5, an alternative embodiement of the invention utilizes an arrow shaped leading edge to indicate the the wind edge (direction of sign orientation desired corresponding to the orientation of the roll in the tube).

The magnetic powder filled thermoplastic base layer (40) preferably comprises from 50 to 95 percent by weight magnetic powder based on the total weight of the base layer, more preferably from 60 to 90 percent by weight thereof, and most preferably form 80 to 90 percent by weight thereof, and preferably comprises a thermoplastic material at a level of from 5 to 50 percent by weight based on the total weight of the base layer, more preferably from 10 to 40 percent by weight thereof, and most preferably from 10 to 20 percent by weight thereof. Preferably the base layer has a thickness of from 15 mil to 60 mil, more preferably from 20 mil to 45 mil, and most preferably 25 mil to 35 mil.

The surface layer is preferably a polyvinyl chloride and optionally may be a polyolefin such as polyethylene or polypropylene. Preferably the surface layer has a thickness of from 1 mil to 16 mils, more preferably from 2 mils to 5 mils and most preferably from 3 mils to 4 mils. The surface layer may be a colored surface layer and may contain a colorant. The surface layer is preferably free of magnetic powder.

Preferably the blank (14) is initially provided in a pre-cut form rolled in a tube (12) of the present invention, and the blank comprises an magnetic powder filled thermoplastic base layer (40) and a (preferably colored) surface layer (42) comprising colorant and thermoplastic resin.

EXAMPLES

An assembly was made according to the present invention by making a clear plastic annular body of polyvinyl chloride resin, a pair of colored end caps of thermoplastic resin, a magnetic signage blank having a magnetic base layer and a vinyl surface layer was rolled and inserted into the tube body with the vinyl layer positioned radially outwardly relative to the base layer, and the caps were placed over the respective ends of the body to close the ends.

What is claimed is:

1. A rolled flexible magnetic laminate adapted for placement into a tube comprising:

a thermoplastic substrate layer having first and second major surfaces, and incorporating magnetic powder in sufficient amounts to provide a magnetic effect to the laminate, and a thermoplastic surface layer adhered to the first major surface of the substrate layer;

the second major surface of the substrate layer including orientation indicia which determines that the exposed surface of the rolled laminate is the thermoplastic surface layer thereon so as to indicate how the laminate is to be rolled when placed inside said tube.

2. A portable signage assembly comprising:

a tube having at least one end opening;

a laminate, as defined in claim 1, being rolled and positioned within said tube according to the indicia on said laminate;

a removable end cap to close off said end opening in said tube.

3. A portable signage assembly as defined in claim 2, wherein instructions for use are adhered to an outer surface of said tube.

4. A portable signage assembly as defined in claim 2, wherein the laminate is magnetized and contains indicia to identify a leading wind resistant edge thereof when magnetically adhered to a vehicle.

5. A portable signage assembly as defined in claim 2, wherein said tube is transparent.

6. The flexible magnetic laminate as defined in claim 1, wherein said substrate layer has a thickness of from 15 mils to 60 mils and said thermoplastic surface layer has a thickness of from 1 mil to 16 mils.

* * * * *